US006435748B1

(12) United States Patent
Taghikhani

(10) Patent No.: US 6,435,748 B1
(45) Date of Patent: Aug. 20, 2002

(54) DISPENSING DEVICE

(75) Inventor: Jay Taghikhani, Mississauga (CA)

(73) Assignee: Plastic Packaging and Components Limited, Ontario (CA)

( * ) Notice: Subject to any disclaimer, the term of this patent is extended or adjusted under 35 U.S.C. 154(b) by 0 days.

(21) Appl. No.: 09/495,980

(22) Filed: Feb. 1, 2000

(51) Int. Cl.[7] ..... A45D 40/04
(52) U.S. Cl. ..... 401/68; 401/75; 401/175
(58) Field of Search ..... 401/68, 75, 171, 401/172, 174, 175

(56) References Cited

U.S. PATENT DOCUMENTS 4,369,158 A * 1/1983 Woorduff et al. ..... 264/268
4,664,547 A * 5/1987 Rosenwinkel ..... 401/175
4,932,803 A * 6/1990 Goldberger et al. ..... 401/75

FOREIGN PATENT DOCUMENTS

CA 2119132 4/1993

* cited by examiner

*Primary Examiner*—Gregory L. Huson
*Assistant Examiner*—Peter deVore
(74) *Attorney, Agent, or Firm*—Heller Ehrman White & McAuliffe LLP

(57) ABSTRACT

A dispenser for volatile material has an enclosure having an opening sealed by a removable first cap member and a stationary barrier at a location opposite the opening; a platform in the enclosure to form a primary cavity between the platform and the opening and an intermediate cavity between the platform and the stationary barrier, the platform being permeable to the volatile material in a molten state for transfer thereof between the primary and intermediate cavities, the platform being movable relative to the stationary barrier to dispense the material through the opening, wherein the platform is operable in a storage position to establish a seal with the stationary barrier to minimize loss of the volatile material.

8 Claims, 6 Drawing Sheets

DISPENSING DEVICE

BACKGROUND OF THE INVENTION

1. Field of the Invention

The present invention relates to dispensers and methods of dispensing materials and more particularly, but not necessarily exclusively, to those for dispensing cosmetic materials such as deodorants or antiperspirants.

2. Description of the Related Art

Deodorant dispensers have been available for many years and offer the consumer a range of deodorants and methods of dispensing them.

Several examples of conventional dispensers are to be found in the prior art. For example, Canadian patent 2,119,132 to Dornbusch et al discloses a dispenser having a elevator assembly which moves against an inner surface of an enclosure under the action of a threaded dial. The elevator assembly has a housing containing a well and an upper surface which is open to the well. Importantly, the elevator has spaced upper and lower seals on its periphery to seal against the loss of material from above the elevator to evaporation. Positioned at the upper end of the enclosure is a cap with a conical inner surface. The dispenser is filled by removing the cap and by depositing a relatively low viscosity molten deodorant material through its upper end. The molten material accumulates on the elevator assembly, while a portion of the deodorant material passes through the elevator assembly into the well. The upper end of the enclosure is then sealed with the cap and the dispenser is flipped over causing the deodorant material to pass into the region of the cap adjacent the conical inner surface and an equivalent amount of material to pass from the well into the space above the elevator assembly. Once the cap is removed, the deodorant material presents a convex surface which makes the application of the deodorant by the user a more comfortable experience. While this dispenser provides an improvement over prior dispensers, its elevator assembly is complex and therefore relatively expensive to produce.

It is in object of the present invention to provide a simplified dispenser for volatile materials.

SUMMARY OF THE INVENTION

Briefly stated, the present invention involves a top-fill and flip dispenser for volatile material, comprising an enclosure having an opening sealed by a removable first cap member and a stationary barrier at a location opposite the opening; a platform in the enclosure to form a primary cavity between the platform and the opening and an intermediate cavity between the platform and the stationary barrier, the platform being permeable to the volatile material in a molten state for transfer thereof between the primary and intermediate cavities, the platform being movable relative to the stationary barrier to dispense the material through the opening, wherein the platform is operable in a storage position to establish a seal with the stationary barrier to minimize loss of the volatile material.

The stationary barrier is separate from the platform and may be a separate and discrete component within the enclosure or may be integrally formed with the enclosure, either for example in the side wall thereof or as constituent of the bottom wall. The platform may include a central portion to extend toward and abut the stationary barrier when the platform is in a storage position. Desirably, a sealing flange is also formed on one or both of the platform and the stationary barrier. Preferably, the central portion includes a cylindrical lower portion bearing the sealing flange.

Conveniently, the dispenser may include means for displacing the platform, including a dial arrangement for displacing the platform by way of a threaded member extending through a passage in the central portion. Alternatively, platform may be displaced by some other arrangement such as a plunger, an example of which is show hereinbelow.

In the case where the stationary barrier is discrete and separate from the enclosure, it desirably has an outer periphery which is sealingly engaged with the inner surface. However, the platform need not be sealingly engaged with the inner surface as will be evident hereinbelow.

Preferably, the enclosure has a neck region and a second cap member is sealingly engaged with the neck region.

In another of its aspects, the present invention provides a top-fill and flip dispenser for volatile material, comprising an enclosure having an opening sealed by a removable first cap member, a stationary barrier at a location spaced from the opening and a platform which is permeable to the material in a molten state, the platform being movable relative to the stationary barrier, wherein the platform and the stationary barrier include complementary sealing surfaces which, in a storage position, form a seal against the loss of the volatile material.

In still another of its aspects, the present invention provides a top-fill and flip dispenser for volatile material, comprising an enclosure having one end sealed by a removable first cap member and a stationary barrier located at an opposite end; a platform in the enclosure to form a primary cavity between the platform and the opening and an intermediate cavity between the platform and the stationary barrier, the platform being movable relative to the stationary barrier to dispense the material through the opening, the platform having at least one passage for the transfer of material, in a molten state, between the primary and intermediate cavities, wherein the platform is operable, in a storage position, to form a seal with the stationary barrier.

In yet another aspect of the present invention, there is provided a method of preparing a dispenser containing a volatile material, comprising the steps of:

(a) providing an enclosure with an opening and a stationary barrier at a location opposite the opening;

(b) locating in the enclosure between the opening and the stationary barrier, a platform which is permeable to the material in a molten state, the platform having an upper end which faces the opening and a lower end which faces the stationary barrier;

(c) depositing sufficient molten material through the opening of the enclosure wherein a major portion of the molten material accumulates on the upper end of the platform and a minor portion of the molten material passes through the platform to a region between the platform and the stationary barrier;

(d) sealing the opening by installing therein a first cap member;

(e) inverting the enclosure to cause the molten material to settle against the first cap member, such that an excess amount of the minor portion of molten material settles on the lower end of the platform and forms a bond with the molten material on the upper end of the platform when the molten material has solidified;

(f) establishing a seal between the platform and the stationary barrier when the platform is in a storage position, thereby to minimize loss of the volatile material.

In still another aspect of the present invention, there is provided a method of minimizing volatile material losses during storage in a dispenser, comprising the steps of:

providing the dispenser with an enclosure, a first cap member to seal an opening in the enclosure, a stationary barrier spaced from the opening, and a platform there between which is permeable to the material in a molten state; and establishing a seal between the platform and the stationary barrier only when the platform is in a storage position.

In still another of its aspects, the present invention provides a method of filling a dispenser containing a volatile material, comprising the steps of:

(a) providing an enclosure with an opening;

(b) installing a stationary barrier at a predetermined location in the enclosure;

(c) locating in the enclosure between the opening and the stationary barrier, a platform which is permeable to the material in a molten state, the platforming having an upper end which faces the opening and a lower end which faces the stationary barrier;

(d) depositing sufficient molten material through the opening of the enclosure wherein a major portion of the molten material accumulates on the upper end of the platform and a minor portion of the molten material passes through the platform to a region between the platform and the stationary barrier;

(e) sealing the opening by installing therein a first cap member;

(f) inverting the enclosure to cause the molten material to settle against the first cap member, such that an excess amount of the minor portion of molten material settles on the lower end of the platform and forms a bond with the molten material on the upper end of the platform when the molten material solidifies;

(g) establishing a seal between the platform and the stationary barrier when the platform is in a storage position.

In yet another of its aspects, the present invention provides a method of adjusting the fill volume of a material dispenser, of the type having an enclosure with an opening, a platform positioned in the enclosure and a dial arrangement for displacing the platform to dispense the material through the opening, comprising the steps of:

(a) installing a stationary barrier in the enclosure and on a side of the platform opposite the opening;

(b) locating the stationary barrier at a predetermined location in the enclosure;

(c) arranging the platform to establish a seal with the stationary barrier when the barrier becomes in contact therewith.

In still another of its aspects, the present invention provides a dispenser for volatile materials comprising an enclosure with an opening and a platform in the enclosure and movable therein to dispense the materials through the opening, sealing means for sealing the enclosure to minimize loss of the volatile materials prior to initial use, the sealing means including a stationary barrier located in the enclosure on a side of the platform opposite the opening, the platform being operable in a storage position to establish a seal with the stationary barrier.

BRIEF DESCRIPTION OF THE DRAWINGS

Several preferred embodiments of the present invention will be provided, by way of example only, with reference to the appended drawings, wherein.

DESCRIPTION OF THE PREFERRED EMBODIMENTS

Figure 1B:
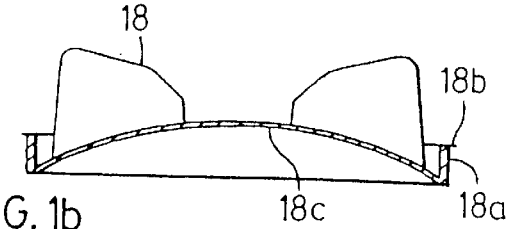
FIGS. 1*a* and 1*b* are side and sectional views, respectively, of two portions of the dispenser of FIG. 1.
Figure 1A:
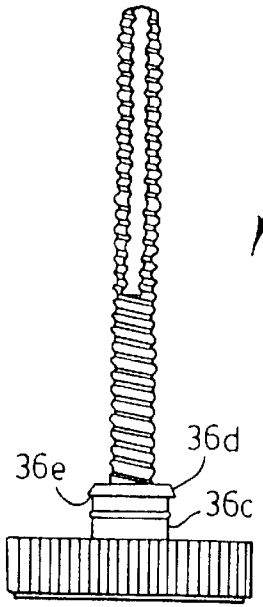

Referring to the FIG. 1 and FIGS. 1*a* through 1*h,* there is provided a dispenser 10 for volatile material. The dispenser has an enclosure 12 having an inner surface 13, an open end 14 and a closed opposite end 16. A removable first cap member 18 seals the open end 14 and a second removable cap member, shown in dashed lines at 20, covers the first cap member.

The end 16 is closed by a bottom wall 22. Positioned above the bottom wall and within the enclosure is a stationary barrier shown at 24. Positioned above the stationary barrier is a platform 26, which is movable relative to the stationary barrier. Conveniently, the platform 26 need not have a close fit with the enclosure, since it is not necessary that the platform be sealed at its periphery for reasons that will be seen hereinbelow.

Together with the first cap member and the enclosure 12, the platform 26 forms a primary cavity 30 for receiving and containing a volatile material. With the stationary barrier 22 and the and the enclosure 12, the platform 26 forms an intermediate cavity 32.

A dial arrangement 36 is located in the lower region of the enclosure and is engaged with the platform 26 in a manner to make it movable relative to the stationary barrier to dispense the material through the open end 14. The dial arrangement has a threaded member 36*a* extending upwardly from a dial handle 36*b*.

Figure 1:
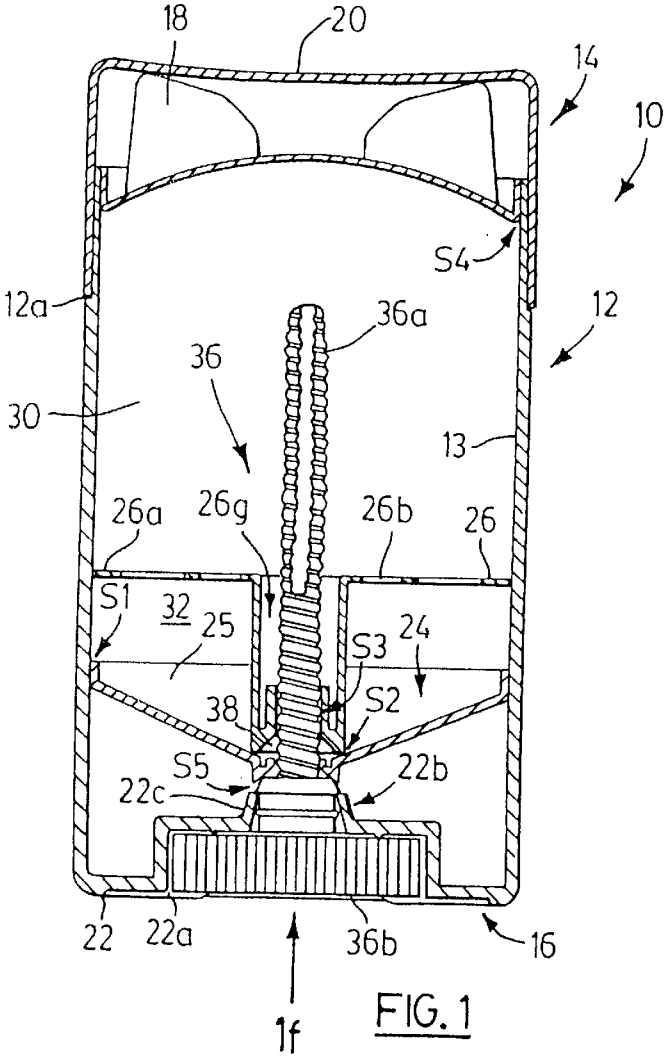
FIG. 1 is a fragmentary sectional view of a deodorant dispenser.
Figure 1D:
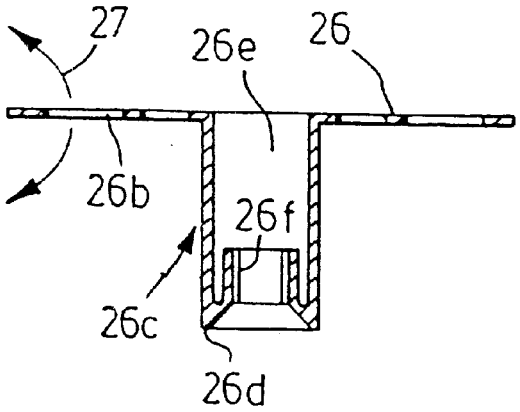
FIG. 1*d* is a sectional view taken on line 1*d*—1*d* of FIG. 1*c;*
Figure 1C:
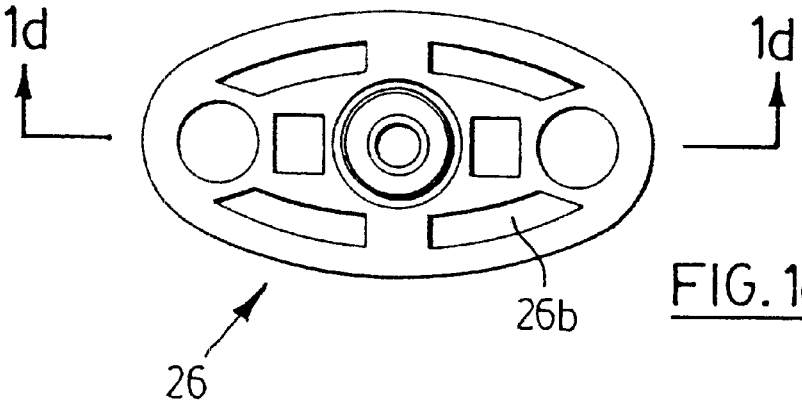
FIG. 1*c* is a plan view of another portion of the dispenser of FIG. 1.
Figure 1E:
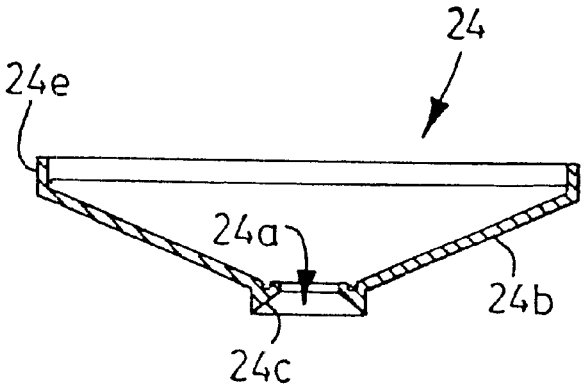
FIG. 1*e* is a sectional view of another portion of the dispenser of FIG. 1.

The platform 26 has an upper planar portion 26*a* with a number of passages 26*b* formed therein for the transfer of the material, in a molten state, between the primary and intermediate cavities 30 and 32 as shown by arrow 27 in FIG. 1*d*. Extending downwardly from the planar portion 26*a* is a cylindrical central portion 26*c* which abuts the stationary barrier in the storage position. Formed on the lower periphery of the central portion 26*c* is a sealing flange 26*d* for establishing the seal between the platform, in its storage position, and the stationary barrier. The central portion 26*c* also includes a central passage 26*e* receiving the threaded member 36*a*. Located in the lower region of the central passage 26*e* is a threaded segment 26*f* which is threadably engaged with the threaded member 36*a* and forms a seal therewith.

Figure 1F:
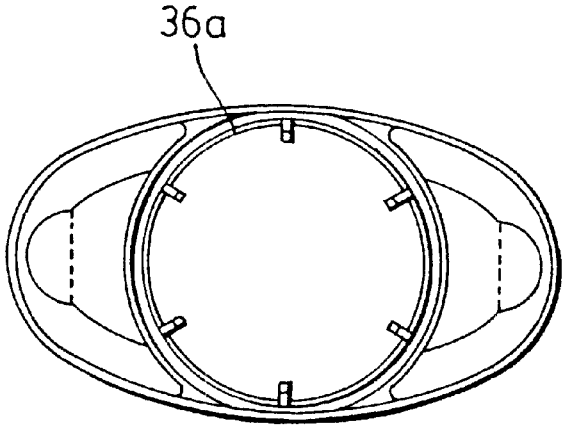
FIG. 1*f* is a view taken on arrow 1*f* of FIG. 1.
Figure 1G:
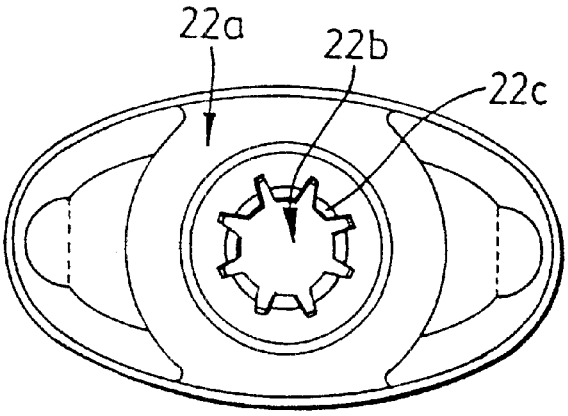
FIG. 1*g* is a view according to FIG. 1*f* of one portion shown therein.
Figure 1H:
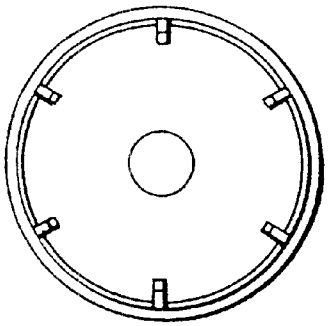
FIG. 1*h* is another view according to FIG. 1*f* with another portion shown therein.
Figure 2B:
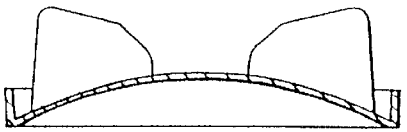
FIGS. 2*a* to 2*d* are sectional views of several portions of the dispenser of FIG. 2.
Figure 2A:
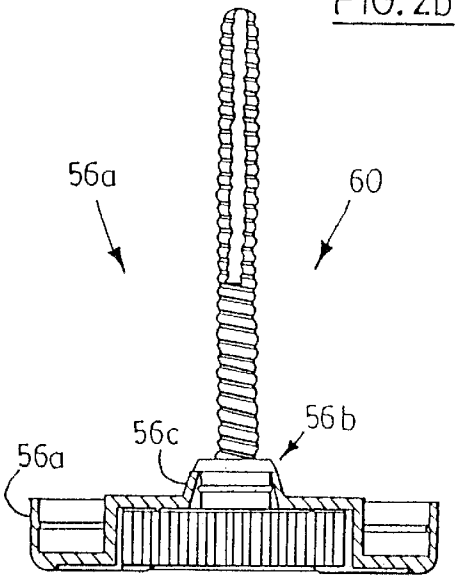
Figure 2D:
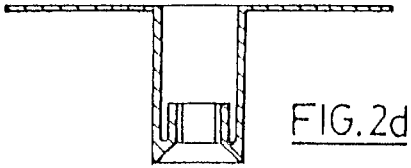
Figure 2:
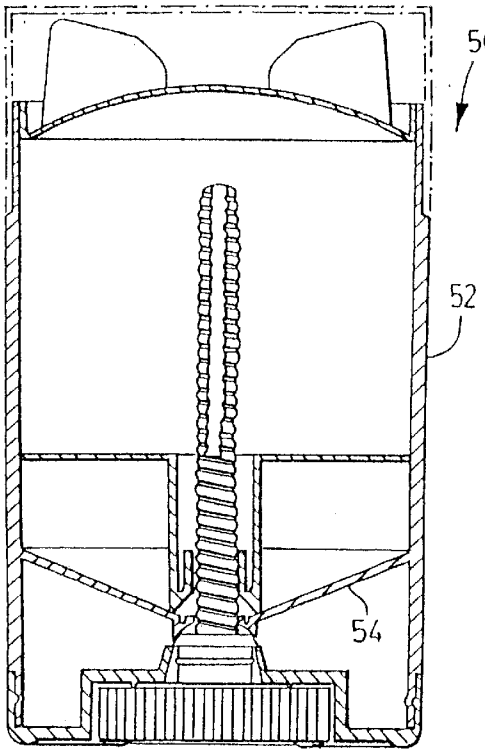
FIG. 2 is a fragmentary sectional view of another deodorant dispenser.
Figure 2C:
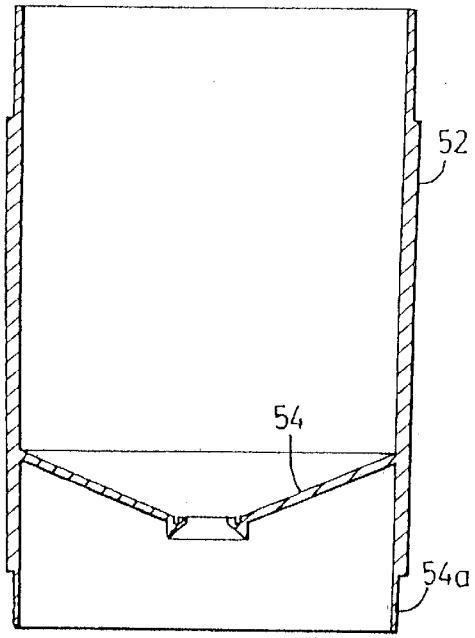

The bottom wall 22 has a part-circular recess 22*a* in which is located the dial handle 36, as shown in FIGS. 1*f* to 1*h*. The bottom wall 22 and the stationary barrier 24 have passages 22*b* and 24*a* respectively which are coaxial with the central passage 26*e* of platform 26 to receive the threaded member 36*a*. The dial arrangement is secured in the opening 22*b* by a number of tabs 22*c* extending from the bottom wall into the opening 22*b*, and which engage the thickened region 36*c* on the threaded member 36*a*.

The stationary barrier 24 has a cup-shaped wall 24*b* extending upwardly and outwardly from the passage 24*a* to form a reservoir 25. Forming the circumference of the passage 24*a* is a flange 24*c*. The thickened region 36*c* on the threaded member 36*a* also includes a beveled upper surface 36*d* which is complementary with the flange 24*c* to form a seal therewith. The thickened region 36*c* is also provided with a raised edge 36*e* which locks against the tabs 22*c* on the bottom wall 22. The wall 24*b* has a periphery 24*e* which is dimensioned to fit closely with the inner surface 13 in order to form a seal therewith. As will be discussed hereinbelow, the stationary barrier may, if desired, be positioned at different locations along the enclosure, as desired, for example to adjust the capacity or "fill volume" of the dispenser, that is the volume of material to be received by the dispenser during filling.

Referring to FIG. 1*b*, the first cap member 18 has a peripheral surface 18*a* which fits closely with the inner surface 13 and a lip 18*b* on the upper boundary of the peripheral surface 18*a* to act as a locating stop for proper positioning of the cap member. The cap has an inner concave surface 18*c* extending inwardly from the peripheral surface 18*a*. The enclosure 12 has a neck region 12*a* and the second cap member 20 slidably engages the neck region.

In use, the dispenser 10 is assembled with the stationary barrier positioned at the lowest end of the enclosure with its annular surface 24*e* in sealing engagement with the inner surface 13 to form a first seal S1. The platform 26 is positioned toward the lower end of the enclosure so that the sealing flange 26*d* abuts the stationary barrier as shown in FIG. 1 to form a second seal S2. A quantity of material in a molten state is delivered to the enclosure causing a major portion thereof to accumulate on the platform.

Given the molten state of the material and the corresponding relatively low viscosity thereof, a minor portion passes through the passages 26*b* to collect in the reservoir 25. In addition, the molten material enters the interior region 26*g* of the central portion against the threaded member 36*a*. The material is then retained in the cavity 26*g* by a third seal S3 formed between the threaded engagement of the threaded region 26*f* and the threaded member 36*a*. The degree to which the third seal S3 is capable of retaining the material in the cavity 26*g* will depend on the tightness of the threaded engagement and its length.

The first cap member is then placed on the enclosure to form a fourth seal shown at S4. The dispenser is then inverted, causing the still-molten material to extend into the cap to fill the cavity adjacent the inner concave surface. Meanwhile, a corresponding quantity of still-molten material passes from the intermediate cavity 32 back into the primary cavity 30 through the passages 26*b* in the platform to replace the material that has been transferred into the cap. The material is then allowed to cool and solidify. In its solid state, the material can no longer pass through the passages 26*b*.

The stationary barrier 24, in its position with its flange 24*c* lying against the complementary beveled surface 36*d*, thereby forms a fifth seal S5. In addition, the stationary barrier, the threaded member 36*a* and the thickened region 36*c* form a residue cavity at 38. During long term storage, residual amounts of certain constituents in the deodorant material, such as glycols or achohols, may migrate down between the threaded region 26*f* and the threaded member 36*a* and into the residue cavity 38. In this case, these residual fluids should be retained in the cavity by the seal S5, thereby preventing unwanted leakage out the bottom of the enclosure and onto the dial.

Thus, the dispenser provides a number of seals to retain essentially all volatile material when the platform is in its storage position, which occurs when the lower sealing flange 26*d* makes contact with the stationary barrier 24 and in the particular case of the dispenser 10, when the flange 24*c* on the latter engages the beveled surface 36*d* on the threaded member.

When the dispenser is operated by a user, the first cap member is removed and the dial is then twisted to flit the platform relative to the stationary barrier, thereby causing the central portion 24 to separate from the stationary barrier, thereby causing seal S2 to be broken.

It is desirable that the platform allow the material to transfer from the major cavity to the intermediate cavity for two reasons. First, the intermediate cavity is to hold a sufficient quantity of the material to supplement the lost material in the enclosure that migrates into the inner region of the cap when the dispenser is inverted. Second, an excess of material in the intermediate cavity allows the material to solidify on the lower side of the platform, thereby forming a bond between the material on both sides. This has the effect of forming a retaining force to retain the material in contact with the platform in order to allow the material to be dispensed both toward the opening and away from the opening and minimizing the risk that the material will break free from the platform.

Another dispenser 50 is shown in FIGS. 2 and 2*a* through 2*d*. In this case, the dispenser has an enclosure 52 and a stationary barrier 54 which is integrally formed therewith. A lower end assembly 56*a* is removably attached to the enclosure by way complementary edge regions 54*a* and 56*a* respectively. The lower end assembly includes a crank arrangement 60 which extends through a passage 56*b* and held therein by tabs 56*c*. In this case, the lower end assembly is snapped into the lower end of the enclosure, thereby bringing the threaded member into the enclosure as with the dispenser 10.

Figure 3:
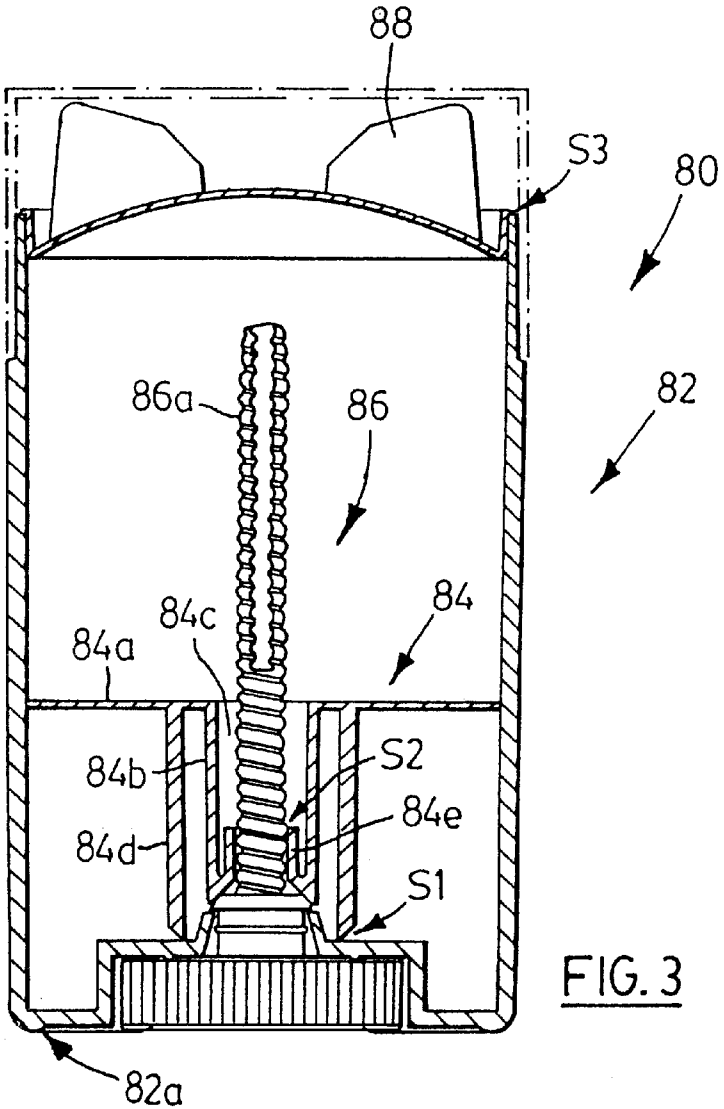
FIG. 3 is a fragmentary sectional view of another deodorant dispenser.
Figure 3A:
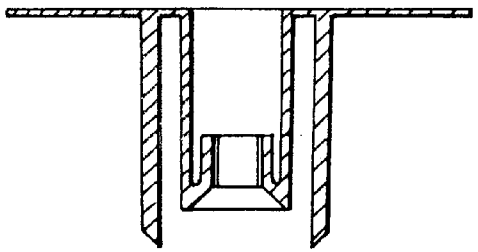
FIG. 3*a* is a sectional view of a portion of the dispenser of FIG. 3.

Another dispenser at 80 in FIGS. 3 and 3*a*, has an enclosure 82 with a bottom wall 82*a* which, in this example, serves as the stationary barrier. As before, a platform 84 is positioned in the enclosure with an upper planar portion 84*a* and a cylindrical central portion 84*b* extending downwardly therefrom. A passage 84*c* in the central portion 84*b* has a threaded segment 84*e* which receives a dial arrangement 86 having a threaded member 86*a*. A sealing flange portion 84*d* also extends downwardly from the upper planar portion 84*a* and is laterally spaced from the central portion 84*b*. The sealing flange portion has a lower end which engages a complementary portion of the bottom wall 82*a* in order to establish a seal S1. Meanwhile, as before, a seal S2 is formed between the threaded member 86*a* and the threaded segment 84*e,* a seal S3 is formed between the inner surface of the enclosure 82 and a first cap member shown at 88. Therefore, the seals needed to prevent loss of the volatile material need not include a seal at the periphery of the platform. In fact, it may be beneficial in some cases that the periphery of the platform be spaced from the inner surface of the enclosure to improve the transfer of molten material between the primary and intermediate cavities.

Figure 4:
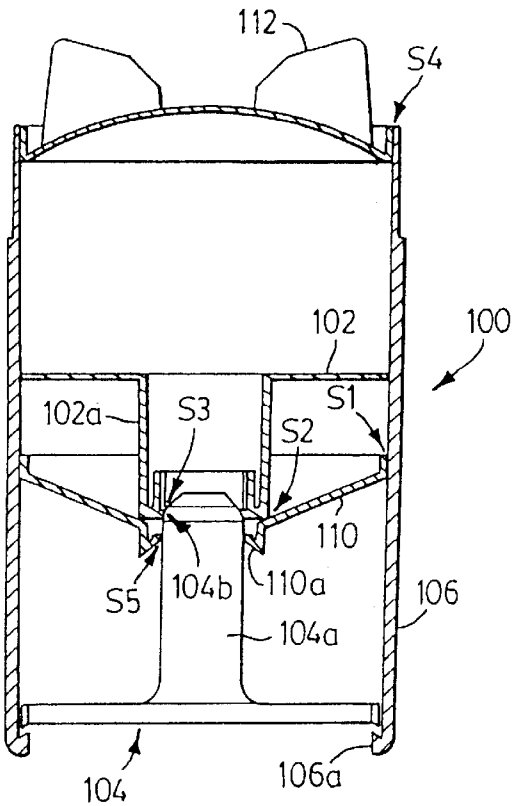
FIG. 4 is a fragmentary sectional view of another deodorant dispenser.

Another dispenser is shown at 100 in FIG. 4. In this case, the platform 102 is displaced by way of a plunger 104 which has a central post portion joined to a lower wall, the latter of which is loosely slidable along the inner surface of the enclosure 106. The enclosure 106 has a lower end which is formed with stops 106*a* to prevent removal of the plunger from the lower end. The central post portion has an upper end 104*b* which is snugly engaged with the lower end of a central portion 102*a* of the platform 102. In this case, a seal S1 is formed between the stationary barrier 110 and the inner surface of the enclosure 106, a seal S2 is formed between the stationary barrier 110 and the lower end of the central portion 102*a,* a seal S3 is formed between the upper end 104*b* of the post portion and the central portion lower end of the central portion 102*a* and finally a seal S4 is formed between the upper end of the enclosure 106 and a cap member shown at 112. Thus, in use, the dispenser 100 is dispensed by depressing the plunger 104 into the enclosure, causing the platform to be displaced, relative to the stationary barrier, toward the opening, causing the seal S2 to be broken. If desired, a seal S5 may also be established between an inner flange 110*a* of the stationary barrier and the central post portion, if need be.

Figure 5B:
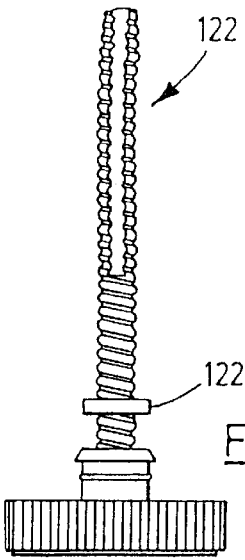
FIGS. 5*a* and 5*b* are fragmentary side views of alternative portions of still another dispenser.
Figure 5A:
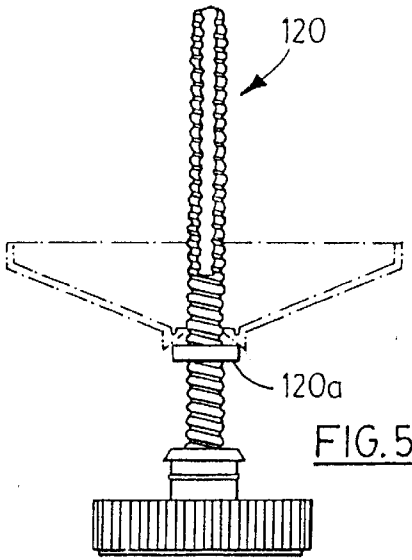

FIGS. 5*a* and 5*b* illustrate alternative threaded members 120 and 122 each having a ring member 120*a*, 122*a* fixed thereto at comparatively different heights. Each ring member has an upper corner region which engages with the stationary barrier when resting on it as shown in dashed lines in FIG. 5*a* to form a seal therewith. Therefore, the ring member provides a convenient and inexpensive way to adapt one dispenser to a range of fill volumes, simply by locating the ring member at the appropriate location. In its storage position, the platform engages the stationary barrier which means that the stationary barrier, in this case, performs the dual function of limiting the lower travel of the platform, as well as forming a seal both with the inner surface of the enclosure opposite the opening and with the platform.

Figure 6:
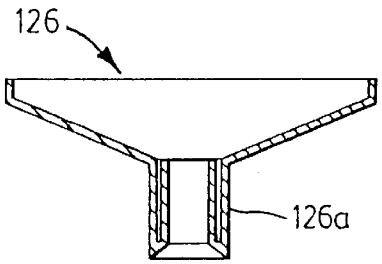
FIG. 6 is a sectional view of an alternative portion to yet another dispenser.

FIG. 6 illustrates an alternative stationary barrier 126 which, in this case, has an extended central portion 126*a* which has the effect of increasing the elevation of the stationary barrier in the enclosure, for example to result in a smaller fill volume in the dispenser 10 shown in FIG. 1, as a replacement for the stationary barrier 24 therein.

It will be understood that the term 'stationary barrier' is intended to mean that the barrier is stationary during the use of the dispenser and has no movement corresponding to the movement of the platform when the latter is displaced. However, the stationary barrier, when separate and discrete from the enclosure, has the advantage that it can be placed at virtually any location along the enclosure and retained there with a suitable anchoring arrangement.

The dispenser and method disclosed herein are particularly suited to the dispensing of cosmetic materials such as deodorants, antiperspirants, lipsticks and perhaps such as things as perfumed gels and the like. The dispenser may also be used for a range of other materials such as cleaning materials for clothing, adhesives, drawing materials such as the waxy materials used in crayons and the like.

It will be understood that the consistency of the material will have some impact on the specific design of the dispenser. For example, materials that have no solid or gel phase in their intended operating conditions may not be suitable. The higher the viscosity of the materials in their molten phase, the greater the size of the openings needed on the platform to ensure that the material does progress into the intermediate cavity. The dispenser and its components may be formed from a number of materials, such as plastic materials, both transparent, opaque and coloured.

What is claimed is:

1. A method of preparing a dispenser containing a volatile material, comprising the steps of:

(a) providing an enclosure with an opening and a stationary barrier at a location opposite said opening;

(b) locating in the enclosure between said opening and said stationary barrier, a platform which is permeable to the material in a molten state, said platform having an upper end which faces the opening and a lower end which faces the stationary barrier;

(c) depositing sufficient molten material through the opening of the enclosure wherein a major portion of the molten material accumulates on the upper end of said platform and a minor portion of the molten material passes through said platform to a region between said platform and said stationary barrier;

(d) sealing said opening by installing therein a first cap member;

(e) inverting said enclosure to cause said molten material to settle against the first cap member, such that an excess amount of the minor portion of molten material settles on the lower end of the platform and forms a bond with the molten material on the upper end of the platform when the molten material has solidified;

(f) establishing a seal between said platform and said stationary barrier when said platform is in a storage position, thereby to minimize loss of said volatile material.

2. A method as defined in claim 1, wherein the stationary barrier is a separately molded part.

3. A method as defined in claim 1, wherein the stationary barrier is integrally formed with the enclosure.

4. A method of filling a dispenser containing a volatile material, comprising the steps of:

(a) providing an enclosure with an opening;

(b) installing a stationary barrier at a predetermined location in the enclosure;

(c) locating in the enclosure between said opening and said stationary barrier, a platform which is permeable to the material in a molten state, said platform having an upper end which faces the opening and a lower end which faces the stationary barrier;

(d) depositing sufficient molten material through the opening of the enclosure wherein a major portion of the molten material accumulates on the upper end of said platform and a minor portion of the molten material passes through said platform to a region between said platform and said stationary barrier;

(e) sealing said opening by installing therein a first cap member;

(f) inverting said enclosure to cause said molten material to settle against the first cap member, such that an excess amount of the minor portion of molten material settles on the lower end of the platform and forms a bond with the molten material on the upper end of the platform when the molten material solidifies;

(g) establishing a seal between said platform and said stationary barrier when said platform is in a storage position.

5. A method as defined in claim 4, wherein the stationary barrier is a separately molded part.

6. A method as defined in claim 4, wherein the stationary barrier is integrally formed with the enclosures.

7. A method of adjusting the fill volume of a material dispenser, of the type having an enclosure with an opening, a platform positioned in the enclosure and a dial arrangement for displacing said platform to dispense said material through said opening, comprising the steps of:

a) installing a stationary barrier in the enclosure and on a side of the platform opposite the opening, b) locating said stationary barrier at a predetermined location in said enclosure;

c) arranging said platform to establish a seal with said stationary barrier when said barrier becomes in contact therewith.

8. A dispenser for volatile materials, comprising an enclosure with an opening and a platform in the enclosure and movable therein to dispense said materials through the opening, sealing means for sealing said enclosure to minimize loss of said volatile materials prior to initial use, said sealing means including a stationary barrier located in said enclosure on a side of said platform opposite said opening, said stationary barrier adjustably positioned in said enclosure in order to establish a lower limit position for said barrier, and said platform being operable in a storage position to establish a seal with said stationary barrier.

* * * * *